United States Patent [19]

Robertson

[11] 4,097,346

[45] Jun. 27, 1978

[54] ELECTROCHEMICAL OXIDATION OF DIACETONE-L-SORBOSE TO DIACETONE-L-KETOGULONIC ACID

[76] Inventor: Peter Murday Robertson, 19 Brüttenerstrasse, Oberwil, Switzerland

[21] Appl. No.: 766,517

[22] Filed: Feb. 7, 1977

Related U.S. Application Data

[63] Continuation-in-part of Ser. No. 559,605, Mar. 18, 1975, Pat. No. 4,040,938.

[30] Foreign Application Priority Data

Apr. 1, 1974 Germany ..... 2415784
Jan. 30, 1975 Germany ..... 2503819

[51] Int. Cl.[2] ..... C25B 3/02; C25B 3/04

[52] U.S. Cl. ..... 204/80; 204/180 P; 204/78; 204/79

[58] Field of Search ..... 204/180 P, 131, 59 R, 204/59 L, 59 QM, 72, 73 R, 75, 76, 78, 80, 272, 260, 301, 79

[56] References Cited

U.S. PATENT DOCUMENTS

| | | | |
|---|---|---|---|
| 2,222,155 | 11/1940 | Pasternack et al. | 204/79 |
| 2,741,595 | 4/1956 | Juda | 204/301 |
| 2,960,452 | 11/1960 | Slager et al. | 204/78 |
| 3,453,191 | 7/1969 | Frohlich et al. | 204/78 |
| 3,697,410 | 10/1972 | Johnson et al. | 204/301 |
| 3,859,195 | 1/1975 | Williams | 204/272 |
| 3,923,629 | 12/1975 | Shaffer | 204/260 |

*Primary Examiner*—Arthur C. Prescott
*Attorney, Agent, or Firm*—Wallenstein, Spangenberg, Hattis & Strampel

[57] ABSTRACT

Process for producing diacetone-L-ketogulonic acid by passing a solution of diacetone-L-sorbose through a specially constructed electrochemical cell while applying electrical current whereby to bring about oxidation of said diacetone-L-sorbose at the anode of said electrical cell, and recovering the diacetone-L-ketogulonic acid from said electrolyzed solution. The electrochemical cell utilizes an electrode which is characterized by its including at least one electrode roll formed by spiralling a deformable sandwich arrangement of electrode layers and spacing layers for preventing direct electrical contact between them, said electrode layers being made of an electrically conductive material, at least one of the spacing layers being ion-permeable and the electrodes and spacing layers having shapes and material structures which co-operate with each other to enable electrolyte flow through said electrode roll or rolls.

10 Claims, 22 Drawing Figures

ELECTROCHEMICAL OXIDATION OF DIACETONE-L-SORBOSE TO DIACETONE-L-KETOGULONIC ACID

BACKGROUND OF THE INVENTION

This invention relates to an improved process for producing diacetone-L-ketogulonic acid by oxidizing diacetone-L-sorbose in a special type of an electrochemical cell.

It may be pointed out that no novelty is claimed broadly in the electrochemical oxidation of diacetone-L-sorbose to diacetone-L-ketogulonic acid, such being well known to the art, being disclosed, for instance, among other published works, in Croat. Chem. Acta, 21, 44 (1972) by G. Vertes, G. Horanyi and F. Nagy. Such prior art processes have, however, been characterized by one or more deficiencies such as low yield, cumberness of carrying out the process, etc., with which those skilled in the art are generally familiar.

The process of the present invention presents various advantages over prior known processes and hinges around the utilization of a novel electrochemical cell construction which has been found to be particularly advantageous for effecting the oxidative conversion of diacetone-L-sorbose to diacetone-L-ketogulonic acid.

SUMMARY OF THE INVENTION

Since the process of the present invention is directly tied in or related to the type of electrochemical cell in which said process is carried out, it is in order to describe, first, the type and construction of the electrochemical cells in which the oxidation of diacetone-L-sorbose to diacetone-L-ketogulonic acid is effected.

At the outset, it may be observed that a very important component of the electrochemical cell is the electrode arrangement contained in it. Since the electrochemical reactions take place at an electrode surface, a major design consideration is to obtain a high electrode area in as small a cell volume as is practicable.

Conventional cell designs have flat electrodes, made of whole sheets or plates, which are either taken in pairs (anode and cathode) or in multiples as in the filter-press design. A disadvantage of this conventional electrode design is the relatively low electrode area per unit cell volume. This limitation has been successfully overcome with porous or particulate electrode (British Chemical Engineering, Vol. 16, No. 2/3, February/March, 1971, pp. 154–156, p. 159), but other difficulties have been introduced. These include the difficulty to maintain a uniform potential and current density distribution within the electode system itself.

In the carrying out of the process of the present invention, an electrode arrangement for electrochemical cells is provided with which a high ratio of electrode area to cell volume and a uniform potential and current distribution within the electrode arrangement is attained by means of a relatively simple cell construction which utilizes minimal materials and which, therefore, also involves low costs.

The electrode arrangements for electrochemical cells utilized in the practice of the present invention comprises a sandwich arrangement of:

at least two electrodes made from deformable material, first insulating means for preventing direct electrical contact between the electrodes, and second insulating means for preventing direct electrical contact between one of the electrodes and other electrodes or other conducting parts of the electrochemical cell, the sandwich arrangement of electrodes and insulating means forming a deformable electrode arrangement, and the electrodes and the insulating means having shapes and material structures which co-operate with each other to enable the flow of an electrolyte through the electrode arrangement.

In a preferred form of such electrode structure the sandwich arrangement is rolled up around a geometrical axis. This form given to the electrode arrangement enables the simultaneous attainment of a high ratio of electrode surface to cell volume and an homogeneous distribution of both current and potential difference within the electrode arrangement.

The electrode arrangement utilized can also be employed for making an electrochemical cell of high capacity, with which the following technical aims can be attained:

a. very high admissible values of the operating voltage and/or current;

b. simple distribution of the electrolyte into the electrode system;

c. minimisation of the construction materials used;

d. simple design making possible mass-production of electrode arrangements and electrochemical cells.

This is achieved with an electrode arrangement comprising at least one electrode roll formed by rolling up the above sandwich electrode arrangement around a hollow axle, which has orifices at certain positions to enable the electrolyte to flow from the interior of the hollow axle into the electrode roll.

DESCRIPTION OF PREFERRED EMBODIMENT OF ELECTRODE USED IN PRACTICE OF THE PROCESS OF THE PRESENT INVENTION

Figure 1:
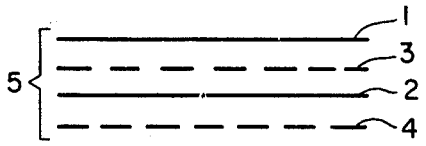
FIG. 1 shows a schematic cross section of an electrode arrangement useful in electrochemical cells for carrying out the process of the present invention.

As schematically shown in FIG. 1, the electrode construction comprises a sandwich arrangement of at least two electrodes 1, 2 made from deformable material, first insulating means 3 which prevent a direct electrical contact between the electrodes, and second insulating means 4 which prevent direct electrical contact between one of the electrodes and other electrodes or other conducting parts (e.g a cell-container) of the electrochemical cell wherein the electrode arrangement is incorporated.

The materials for the electrodes 1, 2 and the insulating means 3, 4 are chosen in order to make a deformable electrode arrangement 5. The materials for the electrodes and the insulating means have shapes and material structures which co-operate with each other to enable the flow of an electrolyte through the electrode arrangement.

For using the electrode arrangement according to the invention in an electrochemical cell, it is convenient to give the electrode arrangement a form enabling to get a maximum ratio of electrode surface to cell volume. This design criterion is satisfied by the electrode roll 6 shown in FIG. 2, which is formed by rolling up the electrode arrangement shown in FIG. 1 around a geometrical axis A—A'.

In the drawings, the electrodes are shown to be rather loosely wound. Although this could be the case in certain applications, e.g. when there is considerable gas evolution from one or more electrodes, for most purposes the electrodes 1, 2 and insulating layers 3, 4 are normally wound tightly around a central core 30 (FIGS. 5, 6) to obtain as high an electrode surface area within the fixed volume of the cell as is required.

The electrode roll 6 is preferably contained in a vessel (not shown in FIG. 2) which has the necessary inputs and outputs and which is suitably of cylindrical construction.

Figure 2:
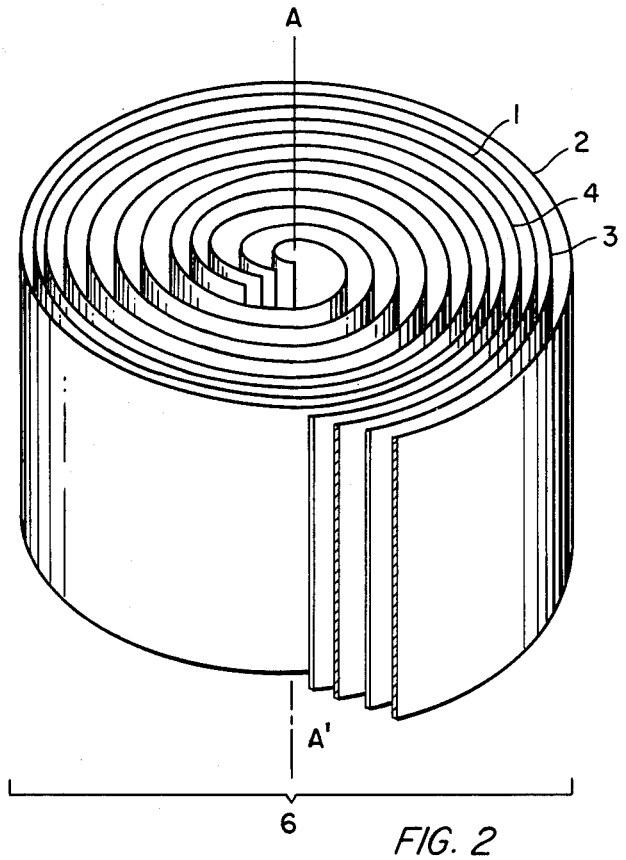
FIG. 2 shows a schematic perspective view of a preferred form given to the electrode arrangement of FIG. 1 for using it in such electrochemical cell.
Figure 3:
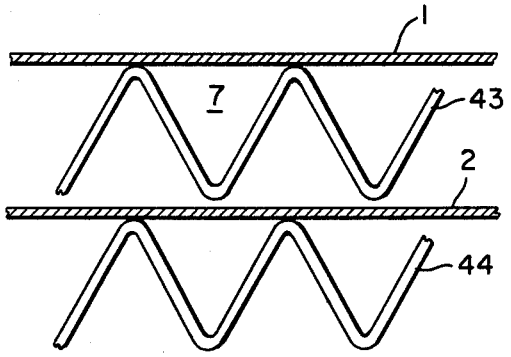
FIG. 3 shows a cross-section of a preferred embodiment of the electrode arrangement of FIG. 1.
Figure 4A:
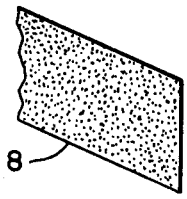
FIG. 4 shows a schematic representation of some material structures that can be used for the electrodes (8, 9, 10, 11) and for the insulating materials (8, 10, 11)
Figure 4B:
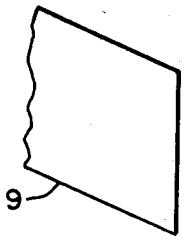
Figure 4C:
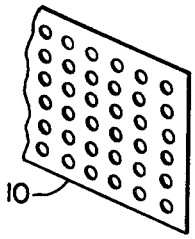
Figure 4D:
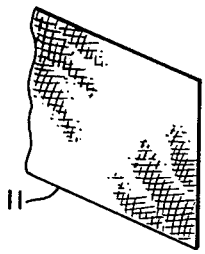

As shown in FIG. 3, the insulating means 43, 44 separating the electrodes 1, 2 in the arrangement of FIG. 2 must serve several purposes. The first one is to electrically insulate electrodes at different potentials from each other. The second one is to co-operate with the electrodes 1, 2 to form cavities 7 to enable the flow of an electrolyte through the electrode arrangement. An additional function of the insulating means can be to separate solutions around different electrodes.

The material for the insulating means can be any chemically inert substance which has a suitable form and material structure. As shown in FIG. 4, the insulating means can be made, e.g. from porous 8 or perforated sheets 10, woven synthetic materials or woven glass fibre 11. The insulating means can also be made from an ion-exchange membrane.

As stated above, besides preventing direct electrical contact between electrodes at different potentials, a second function of the insulating means is to co-operate in providing cavities 7 within the electrode arrangement. These two functions can be achieved with separate components, in which case any of the aforementioned materials for use as an insulator can also be used for forming the cavities 7 between the electrodes. On the other hand specially constructed single materials, e.g. rippled sheets 43, 44, as shown in FIG. 3, or woven materials 11, can be used for performing both functions.

The materials for the construction for the electrodes should have good electrical conductivity, suitable electrochemical properties and good corrosion properties. Most metals are suitable e.g. platinum, gold, palladium, copper, nickel, lead, tin, cadmium or any other suitable metal or alloy thereof. Non-metallic materials can also be used. For instance, carbon which is in a flexible form, e.g. a deposit on an electrically conducting substrate, carbon filaments, woven filaments, or felts, can be used. The electrode may also have special coatings, e.g. oxidised ruthenium or lead dioxide or oxidised nickel hydroxide. As represented in FIG. 4, the electrode rolls can be constructed from sheet materials 9, perforated sheets 10 or gauzes 11.

The vessel holding the electrode roll can be constructed from any chemically inert material that has a suitable mechanical strength.

An electrolyte, which can be a solution or a pure liquid or a mixture or emulsion of solutions or liquids or both, is the feed-stock for the electrolytic cell described hereinafter.

Figure 5:
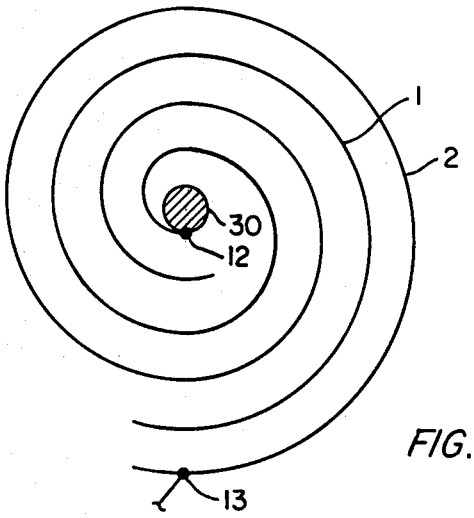
FIG. 5 shows a schematic top view of the electrode arrangement of FIG. 1, wherein each electrode has a single electrical connection (the insulating materials are not shown)
Figure 6:
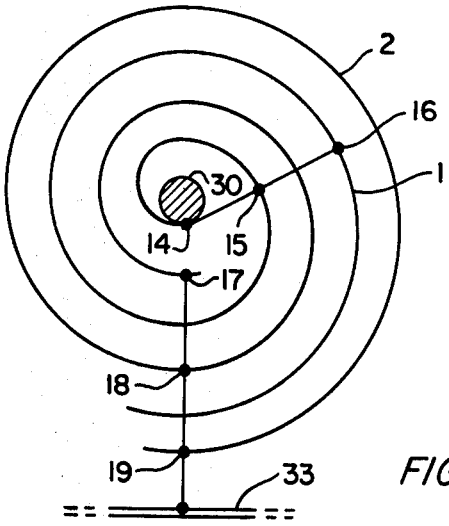
FIG. 6 shows a schematic top view of the electrode arrangement of FIG. 1, wherein each electrode has multiple electrical connections (the insulating materials are not shown)

During operation of the cell, the electrolyte must be made to enter the cavities 7 between the electrodes. This flooding of the cavities may be achieved by running the electrolyte into the electrode-roll in either of two main directions or a combination of these two. The first main direction along which an electrolyte can be fed into the roll is axially, i.e. along the direction of the axis A—A' of the roll. In this case, it is necessary to seal (electrolyte impermeable) the outside of the electrode roll to the inside wall of the container. This is to force the electrolyte to flow through the electrode roll and not around the outside. The second main direction to feed an electrolyte into the roll is radially either inwards or outwards from the central core 30 (FIGS. 5, 6). In this second case the central core of the roll has to be hollow or to provide some other form of pathway for the electrolyte to enter or be removed from the centre. In addition the electrode materials and the insulating means must be electrolyte permeable. As schematically represented in FIG. 4, they could either be porous 8, perforated sheets 10 or gauzes 11.

Electrical energy can be supplied to the electrode roll 6 (FIG. 2) by means of simple and suitable connections.

In the following, some forms of electrical connection are described.

FIG. 5 shows a schematic top view of an electrode roll with two electrodes. Point 12 represents the electrical connection of the electrode and the axle 30. Point 13 represents the connection of the second electrode 2 and the cell container. Electrical power is fed to the electrode roll via the axle 30 and the cell container. This form of electrical connection is suitable, when the voltage drop over the whole length of the rolled electrodes is negligible for the electrochemical process being performed.

FIG. 6 shows a second form of electrical connection with which the electrical power is fed to each electrode at several positions along their length by making power connections to the edges of the coiled electrodes, e.g. at points 14, 15, 16 and, respectively, 17, 18, 19. This second form of electrical connection is suitable for relatively high current inputs, for which the potential drop along the electrode lengths may be prohibitively high if the current feed arrangement of FIG. 5 is used.

Figure 7:
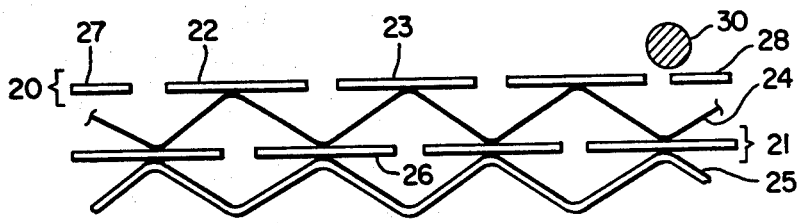
FIG. 7 shows a schematic representation of a cross-section of an electrode arrangement with segmented electrodes for bipolar operation (prior to rolling up)

A third way of feeding electrical power to the electrodes can be achieved with an electrode arrangement for bipolar operation. FIG. 7 shows a schematic cross-section of an electrode arrangement for bipolar operation, prior to rolling it around an axle 30. The electrode layers 20, 21 are formed of conducting segments which are electrically insulated from each other. Each segment 26 of one electrode layer 21 overlaps two halves of adjacent segments 22, 23 of the other electrode layer 20. In bipolar operation, the electrical power is fed by applying the operating voltage between the end segments 27, 28 of the electrode arrangement. As with all bipolar electrode arrangements the total current flowing through the electrode arrangement is the same as for a bipolar arrangement with only one pair of electrodes, while the operating voltage is equal to the potential difference between a working electrode segment and its corresponding secondary electrode segment times the number of such electrode segment pairs, i.e. working and secondary electrode segments.

To achieve efficient bipolar operation it is necessary to employ an insulating separator 24 that enables ionic conduction (solution permeable) between the electrode layers 20 and 21 and an insulating separator 25 that prevents both ionic and electronic conduction between different pairs of electrode layers. This is of importance when the sandwich shown in FIG. 7 is rolled up around the axis 30. When only a pair of electrode layers is used, separator 25 serves to isolate this pair from undesirable electric contacts, e.g. from the cell container.

The use of an electrode arrangement for the purposes of the process of the present invention is described with reference to FIG. 8, which shows a cross-section of an electrolytic cell along its central axis. The electrode arrangement 32 comprises one anode and one cathode. Each electrode is a nickel sheet 3000 × 150 × 0.1 mm. The separator between the electrodes is made of a synthetic cloth. The core of the coiled electrode arrangement is a solid nickel rod 31. The electrode sandwich 32: nickel foil, separator, nickel foil, separator is rolled up tightly around the nickel rod 31. The electrode roll 31, 32 is lodged in a cell container, which comprises a stainless cylinder 34, an upper PVC cover 35 that lodges the upper end of the nickel rod 31 and a perforated PVC disc 36, which is screwed to the lower end of the nickel rod. The nickel rod 31 makes electrical contact with the anode sheet of the roll and is provided with a connection bolt 37 to serve as current feeding to the anode. The cathode sheet of the roll makes a tight press fit with cylinder 34, which is provided with a connection bolt 38 to serve as current feeder to the cathode. The diameter of the central nickel rod 31 is 22 mm and the inside diameter of the container 60 mm. In operation the electrolyte is pumped into the cell at an inlet 39 at the bottom of the container and through the roll 32 in a direction parallel to the axis of the nickel rod 31. The electrolyte leaves the cell at an outlet 40 near the top of the cell container.

The nickel electrodes of the electrolytic cell described above can be pre-treated by electrodeposition of a layer of nickel oxide. This can be done as follows: An aqueous solution: 0.1 M nickel sulphate, 0.1 M sodium acetate and 0.005 M sodium hydroxide is pumped through the cell continuously. A current of 50 amperes is applied to the cell for 5 seconds, the polarity of the supply is then reversed and 50 amperes of the opposite polarity are applied to the cell for 5 seconds. This procedure is repeated 5 times. An active nickel oxide layer is thus obtained.

An alternative method of obtaining an active oxide layer that has been reported in the literature is by cathodic deposition of nickel hydroxide followed by oxidation. This may be typically performed as follows. A 0.1 M solution of nickel nitrate is pumped through the cell and DC electricity applied to the cell at a current density of 10 mA/cm$^2$ for 30 seconds. Nickel hydroxide is precipitated on the cathode. This layer may then be oxidised to the active nickel oxide state by applying electricity of the opposite polarity, while a solution of sodium hydroxide is pumped through the cell.

The following are illustrative examples of the process of the present invention for oxidizing diacetone-L-sorbose (DAS) to diacetone-L-ketogulonic acid (DAG) utilizing electrodes and electrochemical cells such as have been described above, but are in no way illustrative of the full scope of the present invention.

EXAMPLE 1 (AN ILLUSTRATIVE PREFERRED PROCESS)

550 ml of a 10% solution of DAS and 0.3 M sodium hydroxide is pumped through the cell continuously at 60° C while a current of 50 amperes is applied and concentrated sodium hydroxide is added from a dosimat to maintain alkaline conditions. The electrolysis is continued until significant amounts of oxygen evolve from the anode. The solution is then cooled to 0° C and brought slowly to pH = 1 with concentrated hydrochloric acid. DAG precipitates out. It is filtered off, dried and weighed. A 95% material yield is obtained.

EXAMPLE 2 (AN ILLUSTRATIVE ALTERNATIVE PROCESS)

500 ml of a 30% solution of DAS and 2 M potassium hydroxide is continuously pumped through a cell (in which the electrodes are of nickel and pretreated by electrodeposition of a layer of nickel oxide, as described above) while a current of 50 amperes is applied. The electrolysis is continued until significant amounts of oxygen evolve from the enode. The solution is then cooled to 0° C and brought slowly to pH = 1. DAG precipitates out. It is filtered off, dried and weighed. A 95% material yield is obtained.

With respect to the foregoing examples of oxidation of DAS to DAG, it may be noted that the electrodes need not be made of nickel nor need said electrodes have a nickel hydroxide, such as, for instance, $Ni(OH_2)$, active layer on the anode. Generally speaking the electrodes may be made simply of an electrically conductive material, for instance, of metals like copper, iron, cobalt or silver at which an active surface exists for the oxidation of DAS to DAG. The DAS solution passing through the cell most desirably contains sodium hydroxide. However, generally speaking, various other alkaline materials such as potassium hydroxide can be used in the DAS solution passed through the cell. For most efficient oxidation of DAS to DAG, the anodic surface should be as highly active as practicable. This may be achieved not only through the use of a deposited active layer but also, for instance, by using iron electrodes by adding iron salts to the DAS solution, a fact which, per se, is known to the art. It is also to be understood that the practice of the process of the present invention does not have as its aim to produce significant amounts of oxygen at the anode but, rather, to effect oxidation of the DAS at the anode.

In use for the practice of the process of the present invention, the advantages of the electrode arrangement are as follows:

The sandwich structure of the electrode arrangement 5 (FIG. 1) enables use of very thin and even delicate electrode materials.

Three dimensional electrode arrangements like the electrode roll 6 can be made from the basic electrode arrangement 5 depicted in FIG. 1. In this way a mechanically rigid and self-supporting electrode arrangement is made from a deformable one. Such compact electrode rolls enable reaching a high ratio of electrode surface to cell volume when electrode roll is placed in a suitable cell-container.

When the electrolyte flows axially through the electrode roll, the unusual ratio of path width (the length of the electrodes) to path length (the width of the electrodes) enables to minimise the electrolyte residence time within the cell.

With the electrode arrangement 5, it is possible to make very small inter-electrode gaps. This enables minimising the volume of inactive electrolyte and the corresponding power losses. Convection conditions at the electrodes can also be improved by use of small inter-electrode gaps, provided gas is developed at least at one electrode. Additionally important is the fact that uniform mass transport conditions are obtained as follows: The flow of electrolyte through the separator layers 3, 4 can be employed to introduce turbulence into the electrolyte stream. The turbulence given to the electrolyte flow in passing through e.g. a woven cloth separator maintains uniform mass transport conditions over the whole electrode surface. Furthermore, the electrode arrangement 5 makes it possible to supply electrical power to the electrodes in such a way that a very uniform distribution of current and potential difference can be attained within the electrode arrangement.

Figure 8:
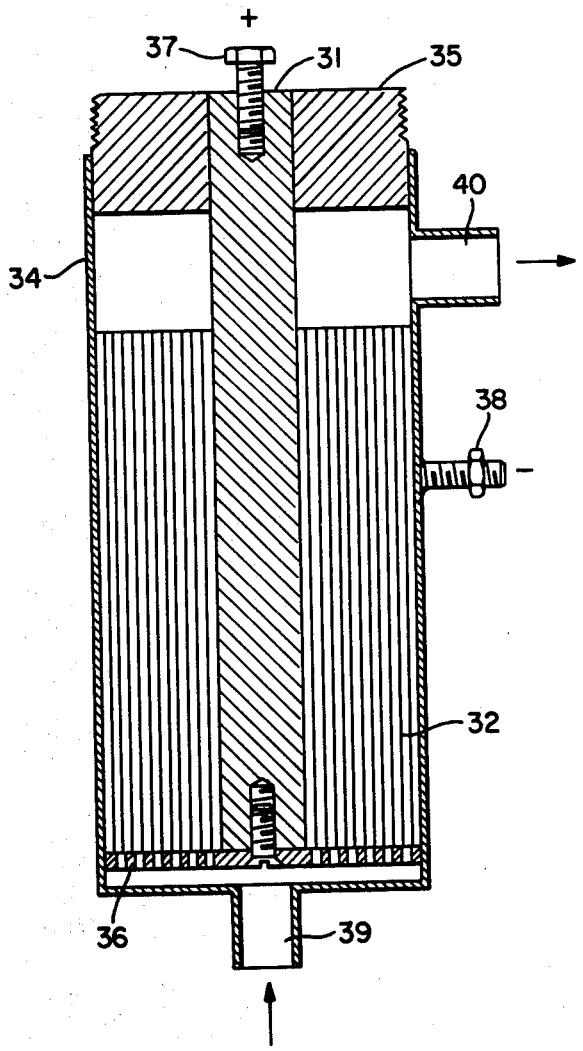
FIG. 8 shows a schematic cross-sectional view of an electrolyte cell which contains an electrode arrangement useful in practicing the process of the present invention.

As already mentioned above scale-up of the current with the simple electrode roll of the cell shown by FIG. 8 is limited by potential drops along the electrodes.

In the following, three preferred embodiments of electrode arrangements for effective use in the practice of the present invention are described, with which inter alia the above scale-up limitation can be overcome.

Figure 9:
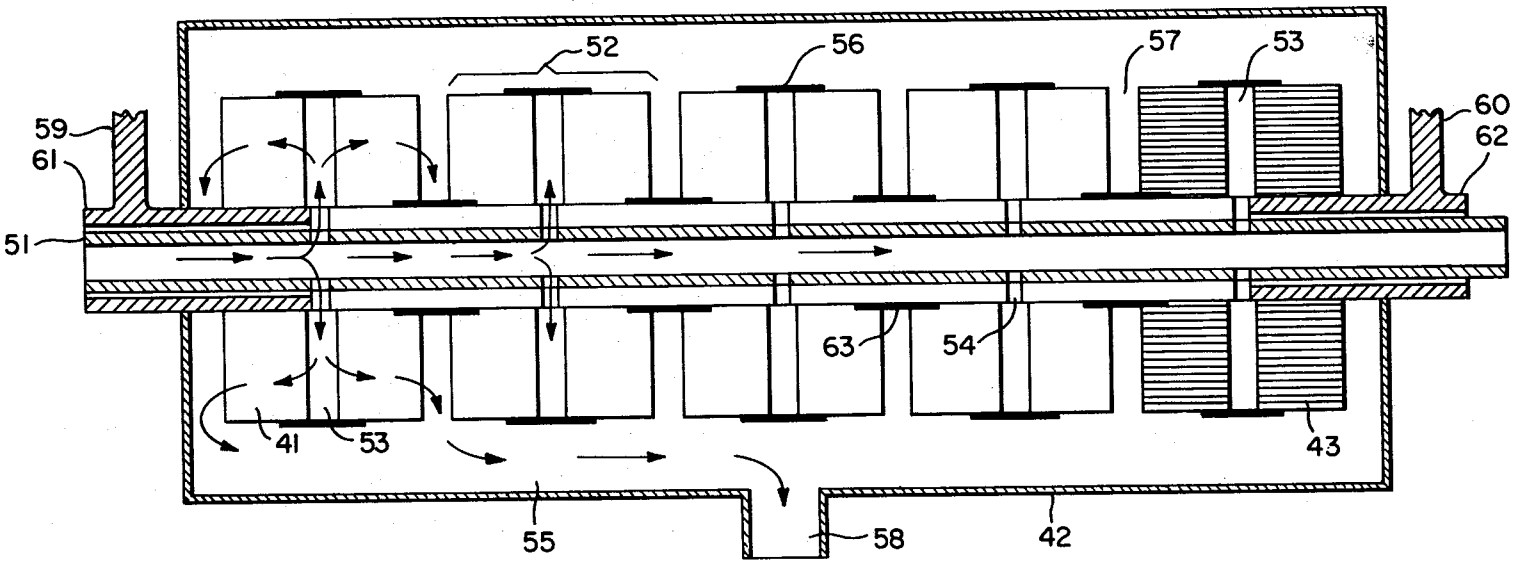
FIG. 9 shows a schematic cross-section of a first embodiment of an electrochemical cell which comprises several electrode rolls of the type shown in FIG. 2.
Figure 10:
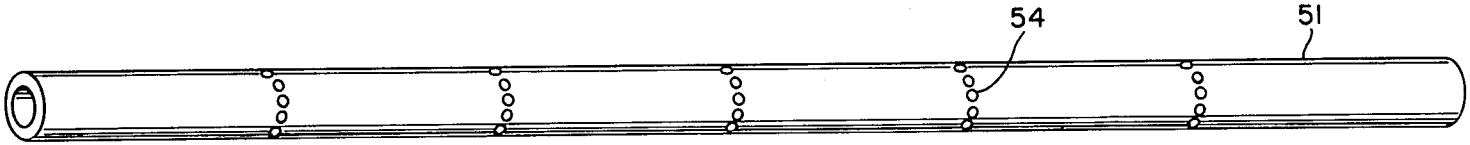
FIG. 10 shows a perspective view of a preferred form of the axle of the electrochemical cell shown in FIG. 9.
Figure 11:
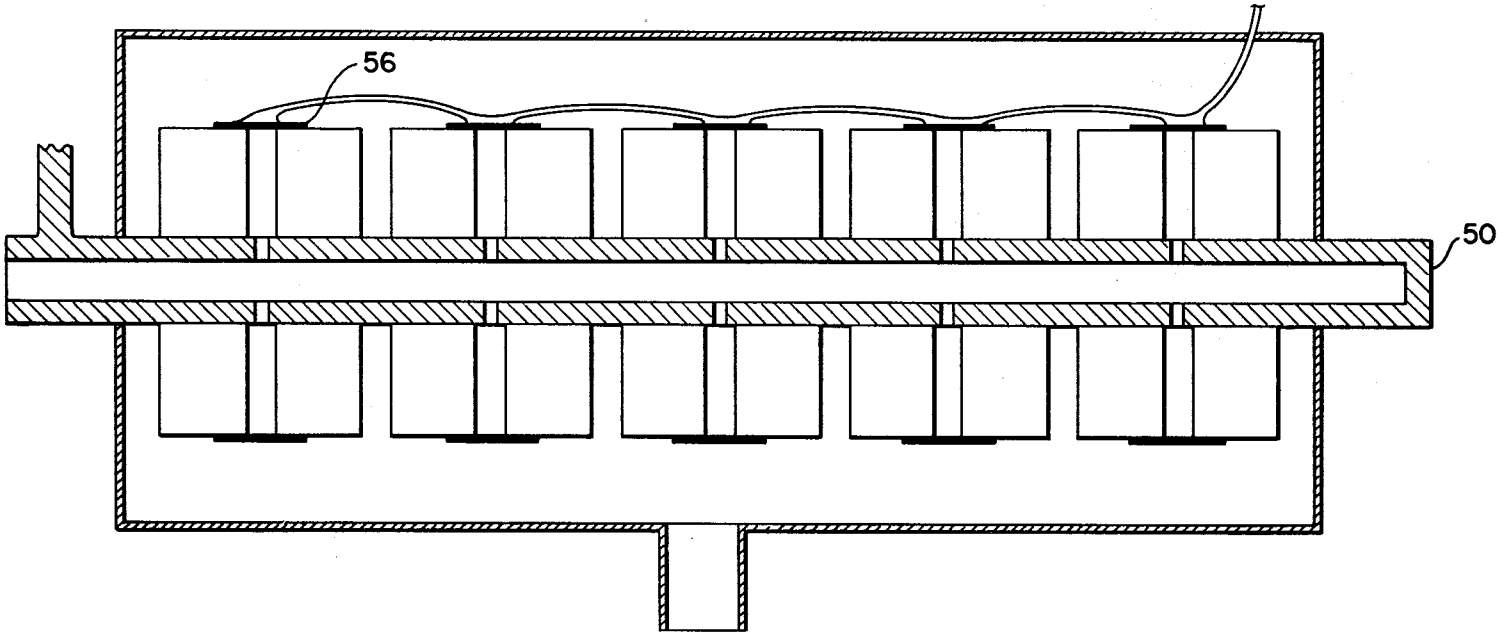
FIG. 11 shows a schematic representation of one form of electrical connection of the electrochemical cell of FIG. 9, FIGS. 12*a* and 12*b* show a schematic top view and a schematic cross-section of the electrode arrangement (prior to rolling it) which is used in a second embodiment of an electrochemical cell.

Embodiment 1 (FIGS. 9, 10, 11)

FIG. 9 shows an electrochemical cell comprising a number of electrode rolls 43 arranged on an axle 51. FIG. 9 shows a cell with 10 electrode rolls. This number is just an example. However, an even number will usually be employed. The main features of this embodiment are as follows:

The axle of the cell is hollow, e.g. a pipe. The electrode rolls 43 are of the type described above with reference to FIG. 2. The electrode rolls are arranged in pairs 52 with a gap 53 between them. In operation, the electrolyte is fed into the gap 53 of each pair of electrode rolls through orifices 54 of the axle 51. The gap 53 is wide enough to enable convenient flow of electrolyte between the electrode rolls forming a pair. The electrolyte is prevented from exiting directly into the space 55 surrounding the core of the cell by a leak-proof metallic band 56 which joins together the electrode rolls forming a pair. The electrolyte is thus forced to flow through each pair 52 of electrode rolls, that is, through the cavities 7 (see FIG. 3) within the electrode arrangement. After flowing through the electrode rolls, the electrolyte exits from the cell by running through gaps 57 between adjacent pairs of electrode rolls into space 55 surrounding the core of cell and out by an outlet 58. Electrical connection to the row of electrode rolls can be either parallel or series. In FIG. 9 the series connection is shown. Power is fed to the two end rolls 41, 43 only, in one case the electricity being fed to the anode and in the other case to the cathode. The electricity is fed from the power source through bus-bars 59, 60 to isolated metal sections 61, 62 of the axle 51, which act as current feeders to the two end rolls. The rolls which form a pair are electrically connected together by the metallic bands 56, and the rolls of different pairs are connected by isolated conduction sections 63 of the axle. FIG. 11 shows the parallel electrical connection of the electrode rolls. In this case, the axle 51 comprises a continuous electrical conductor 50 which makes electrical connection with one electrode of each roll and the metal bands 56 act as the current feeders to the other electrodes.

The materials and construction of each roll are as described previously and illustrated by FIGS. 1, 2, 3, 4. The use of a bipolar arrangement as shown in FIG. 7 is also possible.

With this first embodiment, the above design aims (*a–d*) when making an electrochemical cell for use in the practice of the process of the present invention can be achieved as follows:

Aim (a) is achieved by the use of several electrode rolls. Aim (b) is achieved by the use of a hollow axle with orifices to distribute the electrolyte into the rolls. Aim (c) is achieved by eliminating the need to have a tight fitting metal container for the rolls. Aim (d) is achieved by constructing a large capacity cell from many small units of the same type.

Embodiment 2 (FIGS. 12, 13, 14, 17*a*)

Figure 12A:
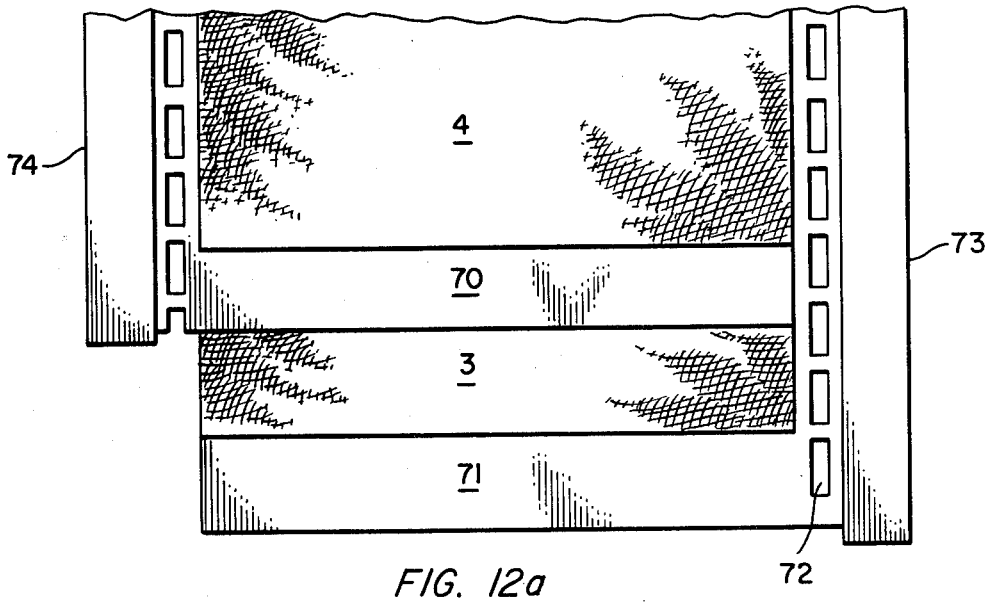
Figure 12B:
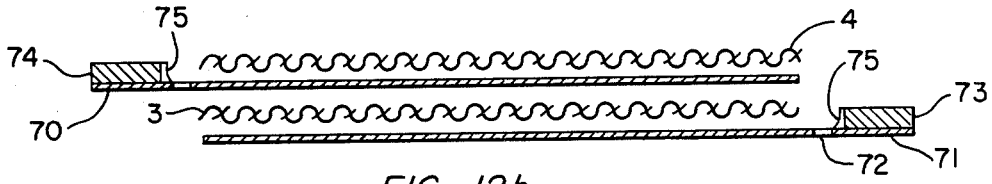
Figure 14:
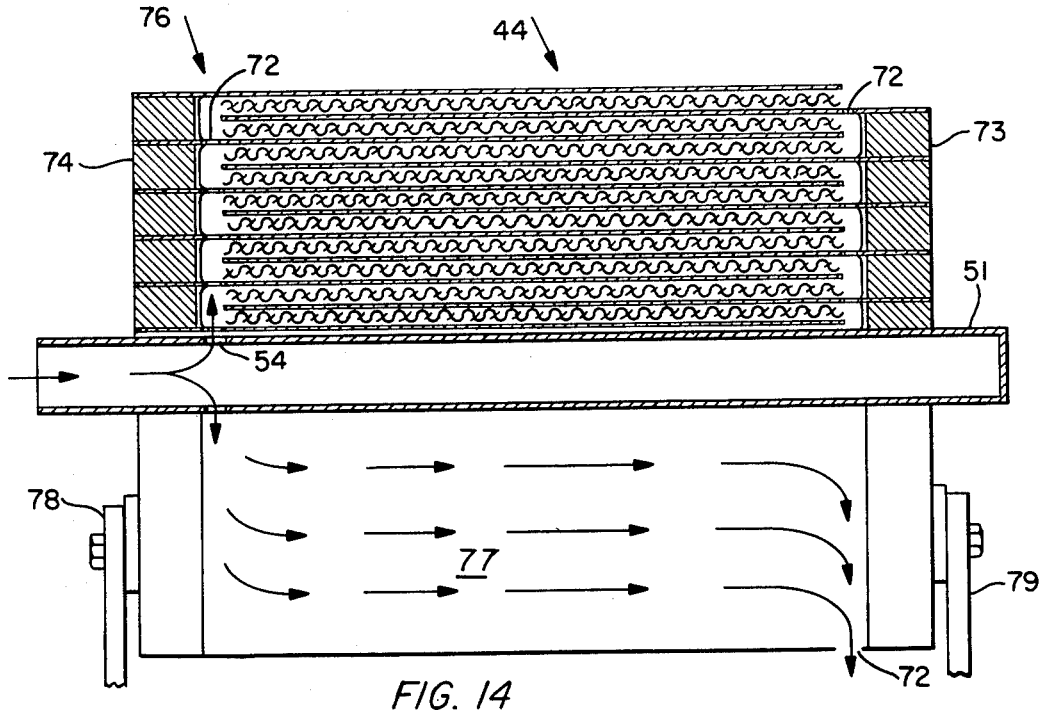
FIG. 14 shows a schematic cross-section of the electrode roll of FIG. 13.
Figure 13:
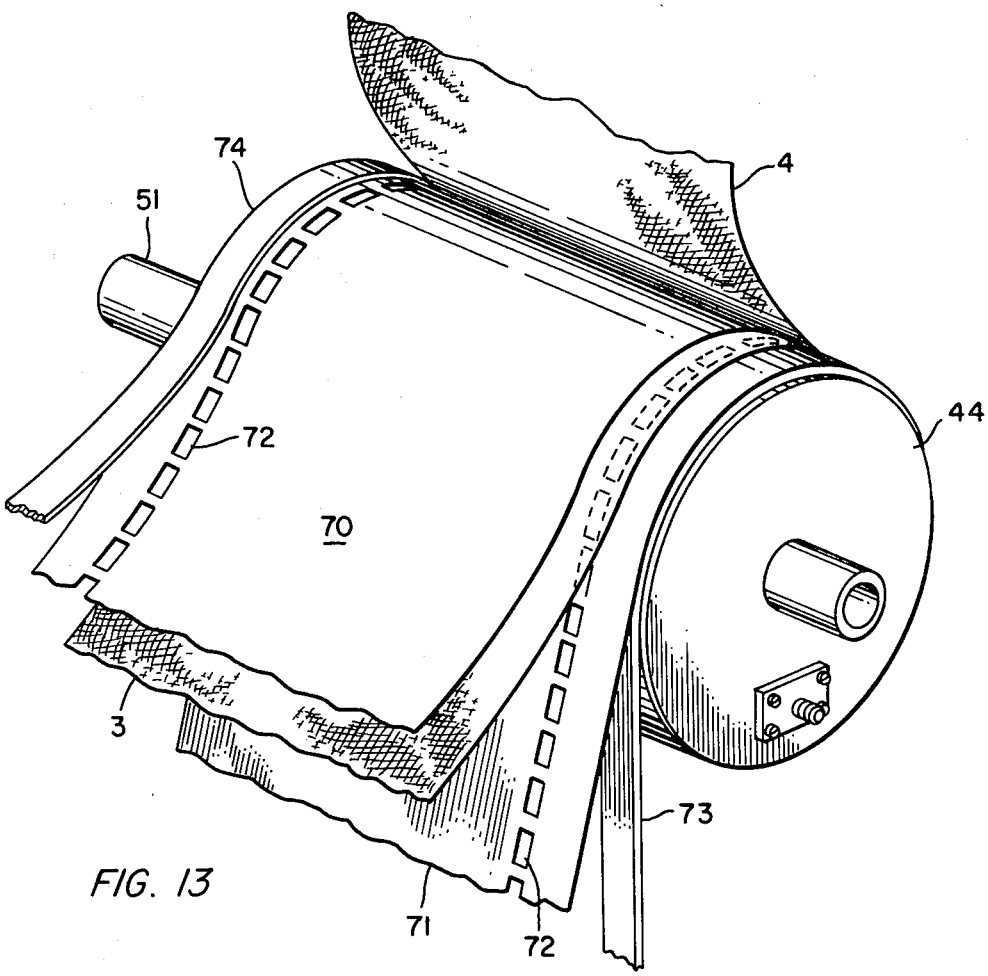
FIG. 13 shows a perspective view of an electrode roll made by rolling up the electrode arrangement of FIG. 12.

Referring to FIG. 14 it can be noticed that, like in Embodiment 1, the electrolyte is introduced in the electrode roll 44 of the cell through orifices 54 of the axle 51. The electrode arrangement used for this Embodiment is shown in FIG. 12. It comprises 6 elements: a cathode 70 and an anode 71 both using an electrode material with perforations 72 at one side; two insulating means 3, 4 and two end sealing strips 73, 74. The end sealing strips are constructed from an electrically conducting material (e.g. metal). A sealing compound or aid 75 can also be used to improve the seal. The necessary overlapping of the layers is shown in FIG. 12 which includes both a top view and a cross-section of the electrode arrangement prior to rolling it. FIG. 13 shows the electrode arrangement of FIG. 12 being rolled up around the axle 51. The metal strips 73, 74 are of a suitable thickness so that the ends of the roll are solid with no possibility of a leak of electrolyte from within the roll. As shown in FIG. 14, the electrolyte is pumped into the roll through the holes 54 in the axis and the perforations 72 of one of the electrode sheets. The electrolyte is prevented from exiting directly from the cell by closing off the path provided through the perforations 72 at the surface of the electrode roll with some leak-proof seal 76. The electrolyte flow path 77 goes through the roll to the other end where it is free to exit through the perforations 72 of the other electrode.

The electrical connection to the electrode roll is made by mounting the bus-bars directly onto the ends of the electrode roll as in 78, 79. These provide connection to the complete longitudinal edge of each electrode. This enables an almost limitless scale-up of the length of the electrodes and of the diameter of the electrode roll.

The materials for making the electrode roll of FIG. 13 are as follows:

The materials for the insulating means 3, 4 are as described previously. The electrodes are sheet form using materials as described above. An important difference however is the introduction of a row of perforations 72 along one side and over the whole length of each electrode. The perforations 72 of the electrode sheets act as openings for distributing the electrolyte from the hollow axis into the electrode roll. The perforations 72 of one electrode serve as inlets and the perforations 72 of the other electrode as outlets. The position of the electrode roll on the axle 51 enables an easy flow of the electrolyte through the orifices 54 of the axle and through the inlet perforations 72.

A sealing strip 73, 74 is incorporated in the electrode arrangement at both sides. It must be constructed from an electrically conducting material that does not corrode and is electrolyte impermeable. The sealing strip is about the thickness of two layers of insulating material plus one layer of electrode material. The sealing strip acts as a means of conducting the electricity across the ends of the roll making contact with the whole side of one particular electrode and as a means of stopping axial electrolyte flow out through the ends of the roll.

With this second embodiment, the above design aims (*a–d*) when making an electrochemical cell are achieved as follows:

Aim (a) is achieved by the form of power feeding employed, which enables use of electrodes of almost unlimited length for making the electrode roll, that is, the diameter of the roll can also be scaled-up, almost at will. This makes possible an almost limitless scale-up of the reactor current with a single electrode roll, rather than with a plurality of them, as in Embodiment 1. Aim (b) is achieved through the use of a hollow axis with perforations and perforated electrode sheets. Aim (c) is achieved since the bulk of the construction materials are the electrodes themselves. Aim (d) is achieved by the use of simple winding equipment for making the cell.

Embodiment 3 (FIGS. 15, 16, 17*a*, 17*b*)

This is a modification of Embodiment 2, wherein the main features of Embodiment 2 are retained, but in addition the electrode arrangement used is a much broader one and incorporates several bipolar electrode sheets placed side by side so as to enable scale up of the cell voltage as well as of the current. This third Embodiment achieves the design aims as Embodiment 2 and in addition makes possible scale-up of cell voltage also [Aim (a)].

Figure 17A:
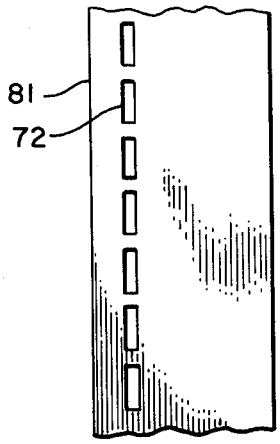
Figure 17B:
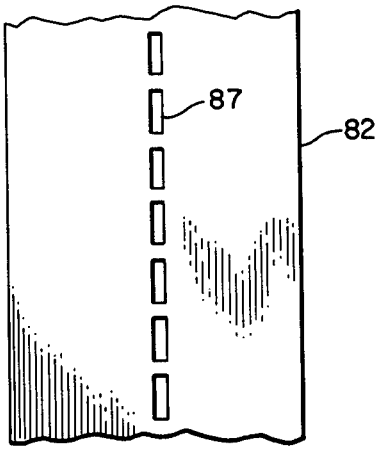
Figure 15:
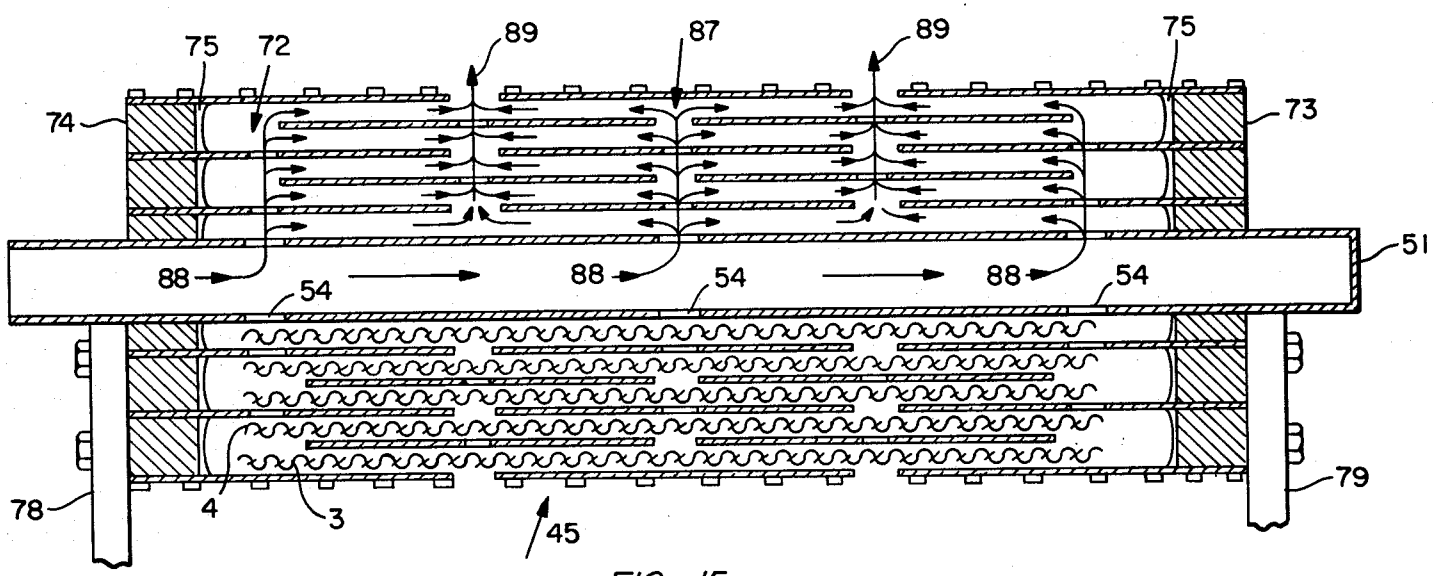
FIG. 15 shows a schematic cross-section of the bipolar electrode arrangement which is used in a third embodiment of an electrochemical cell.
Figure 16:
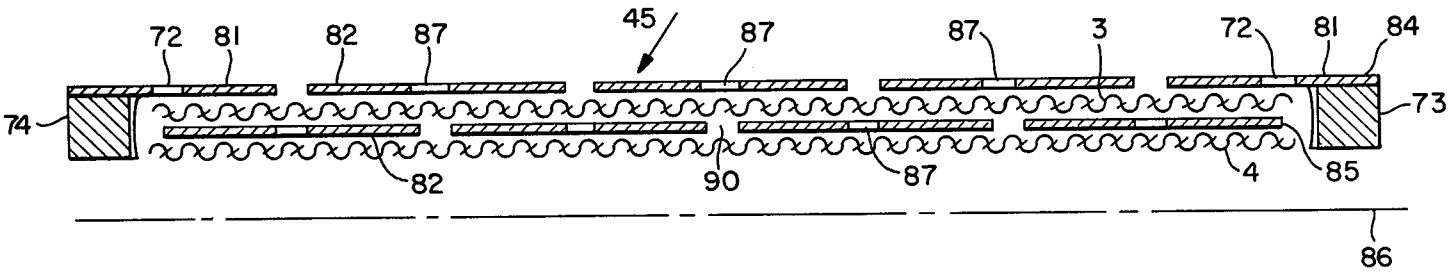
FIG. 16 shows a schematic cross-section which illustrates in detail the structure of the electrode arrangement of FIG. 15, FIGS. 17*a*, 17*b* show a top view of the electrode strips employed for making the electrode arrangement shown in FIGS. 15 and 16. The electrode strip of FIG. 17*a* is also employed for making the electrode arrangement shown in FIGS. 12, 13, 14.

Referring to FIG. 15, it can be seen that like in Embodiments 1 and 2 the axle 51 of the cell is hollow. The electrolyte is pumped in an electrode roll 45 through perforations 54 of the axle 51 and through perforations (72, 87) of the electrodes. The electrode arrangement used for this embodiment is illustrated by FIGS. 15 and 16. The electrode roll 45 has four layers, which are rolled up around the axle 51, the position of which is indicated by line 86 in FIG. 16. The insulating means 3, 4 are as described previously. One of the electrode layers 84 is constructed from N electrode sheets 82 placed side by side with uniform spaces 90 between them and two end electrode sheets 81. The other electrode layer 85 consists of N+1 electrode sheets 82, which are also placed side by side with uniform spaces 90 between them. The sheets of one electrode layer are placed so as to overlap two halves of adjacent sheets of the other layer. This overlap is shown in FIG. 16 and is necessary for the bipolar operation of each electrode sheet. As shown by FIGS. 16 and 17*a*, 17*b*, the end electrode sheets 81 of the widest electrode layer 84 have slots 72 along one side so as to allow the circulation of electrolyte. The other sheets 82 of the electrode layer 84 are broader (about two times the width of 81) and have perforations 87 down their centre area and over their whole length. As shown by FIG. 15, the perforations 72, 87 of the sheets of the wider electrode layer 84 lie facing the orifices 54 along the axis 51. This enables the flow of the electrolyte through path 88. The electrolyte exits through outlets 89. Each outlet 89 lies in front of a perforation 87 of the other electrode layer 85. As in Embodiment 2, a sealing and electrically conducting strip 73, 74 completes the electrode arrangement at each end.

The electrical connections to the electrode roll 45 are similar to the ones of Embodiment 2, the electricity being fed directly only to the side-most electrode sheets. The other sheets acting in a bipolar fashion transfer the electricity through the electrode arrangement.

The materials for making the electrode arrangement of this third embodiment are similar to the ones described for Embodiment 2, but the electrode sheets for bipolar operation differ from the ones previously described in that the perforations would normally be down the centre area of the electrode and distributed along its complete length.

A common feature of all three Embodiments described above is the use of a hollow axis 51 with perforations 54 for feeding the electrolyte into the electrode roll(s). As the axle should not short-circuit electrodes with different potentials, the axle has either to be made of non-conducting material or to have a structure which prevents such short-circuits. The axle 51 can also be constructed in a concentric fashion with the outermost tubes acting as current feeders for the electrodes. Current feeders at different potentials have of course to be electrically insulated from each other. As the axle 51 acts in addition as a means of support for the electrode rolls, it will normally be constructed from materials that are strong enough to support the rolls and also a corrosion resistant material.

I claim:

1. Process for producing diacetone-L-ketogulonic acid by passing a solution of diacetone-L-sorbose through an electrochemical cell, in which said cell includes at least one electrode roll formed by spiralling a deformable sandwich arrangement of electrode layers and spacing layers for preventing direct electrical contact between them, said electrode layers being made of an electrically conductive material, at least one of the spacing layers being ion-permeable and the electrodes and spacing layers having shapes and material structures which cooperate with each other to enable electrolyte flow through said electrode roll or rolls, while applying electrical current whereby to bring about oxidation of said diacetone-L-sorbose at the anode of said electrochemical cell, said anode having an active surface for the said oxidation, and recovering the diacetone-L-ketogulonic acid from said electrolyzed solution.

2. The process of claim 1, wherein the solution of diacetone-L-sorbose to be electrolyzed is an alkaline solution.

3. The process of claim 1, wherein, after completion of the electrolyzing of said solution, said solution is cooled to a low temperature and the pH is adjusted to a low pH whereby the diacetone-L-ketogulonic acid precipitates out from said electrolyzed solution.

4. The process of claim 1, wherein the electrode layers are longitudinally segmented for bipolar operation, each electrode segment of one of the electrode layers overlapping aproximately two halves of adjacent segments of the other electrode layer and the end segments of one of the electrode layers having each a terminal for electrical connection; and the insulating means between electrodes that form a pair for bipolar operation enable ionic conduction, whereas the insulating means between different electrode pairs, that is, electrode pairs other than the pair designed to operate together, prevent both ionic and electronic conduction between electrodes of such different pairs.

5. The process of claim 1, wherein for enabling electrical power feed through the axial ends of the electrode roll each longitudinal side of the sandwich arrangement includes a strip-shaped layer of electrically conducting material which overlaps and is in direct electrical contact with one longitudinal edge of one electrode, so that the electrode structure formed by rolling the sandwich arrangement has conducting ends, each end enabling to feed electrical current to the whole length of one electrode layer.

6. The process of claim 1, wherein the electrode roll is rolled up around a hollow axle, the hollow axle and the electrodes having each orifices at specified positions, which orifices cooperate with each other for enabling electrolyte flow from the interior of the hollow axle into the electrode roll, the position of the orifices being so specified that the electrolyte flows first in a direction perpendicular to the axle and then parallel thereto.

7. The process of claim 1, wherein the electrochemical cell includes at least two electrode rolls, the electrode rolls being rolled up around a hollow axle and arranged by pairs, each pair having a gap between the electrode rolls and the hollow axle having orifices which enable electrolyte flow from the interior of the hollow axle into the gap of each pair of electrode rolls.

8. The process of claim 5, wherein the electrically conducting strip-layers are placed on the longitudinal edges of the electrode layers prior to rolling and are rolled with the electrode arrangement for sealing both ends of the electrode roll in axial direction.

9. The process of claim 6, wherein the electrode roll includes at least one pair of electrode layers for bipolar operation, each of which is composed of a plurality of perforated electrode strips, which are rolled around the axle in spaced relationship, each strip of one electrode layer overlapping approximately two halves of adjacent strips of the other electrode layer.

10. The process of claim 7, wherein the electrochemical cell further comprises a leak-proof band around each pair of electrode rolls, for closing the gap between the electrode rolls, whereby the whole of the electrolyte flowing into the gap is forced to flow through the electrode rolls.

* * * * *